US006145853A

United States Patent [19]

Croshaw

[11] Patent Number: 6,145,853

[45] Date of Patent: Nov. 14, 2000

[54] SKATE STRUCTURE WITH LONGITUDINALLY ALIGNED WHEELS

[75] Inventor: Philip Mark Croshaw, Sark, United Kingdom

[73] Assignee: Novus S.r.l., Milano, Italy

[21] Appl. No.: 09/120,178

[22] Filed: Jul. 22, 1998

[30] Foreign Application Priority Data

Oct. 10, 1997 [IT] Italy ..... VE97A0044

[51] Int. Cl.[7] ..... A63C 17/06; A63C 17/26

[52] U.S. Cl. ..... 280/11.22; 280/11.19; 280/11.3; 280/11.36

[58] Field of Search ..... 280/11.19, 11.2, 280/11.22, 11.26, 11.3, 11.36

[56] References Cited

U.S. PATENT DOCUMENTS

| | | | |
|---|---|---|---|
| 833,100 | 10/1906 | Wells | 280/11.36 |
| 926,646 | 6/1909 | Eubank | 280/11.2 |
| 979,169 | 12/1910 | Kennedy | 280/11.23 |
| 1,167,183 | 1/1916 | King | 280/11.36 |
| 1,188,335 | 6/1916 | Shoemaker | 280/11.23 |
| 1,529,967 | 3/1925 | Stanley et al. | 280/11.36 |
| 2,240,532 | 5/1941 | Warner | 280/11.36 |
| 4,072,317 | 2/1978 | Pommerening | 280/11.23 |
| 4,284,292 | 8/1981 | Faulin | 280/11.36 |
| 4,844,491 | 7/1989 | Wheelwright | 280/11.2 |
| 5,713,587 | 2/1998 | Morrow et al. | 280/14.2 |
| 5,860,492 | 1/1999 | Talaska | 280/11.2 |

*Primary Examiner*—Lanna Mai
*Assistant Examiner*—Ruth Ilan
*Attorney, Agent, or Firm*—Hoffman, Wasson & Gitler, PC

[57] ABSTRACT

A skate structure with longitudinally aligned wheels includes an inverted U-shaped frame, in the flanges of which there engage the ends of pivot pins for the wheels. The upper surface of the frame is provided with straps for the removable fixing of an article of footwear. The rear portion of the skate structure has an arm connected by a hinge. The upper element of the arm is provided with an element for securing a user's leg. The arm is pivotal about the axis of the hinge, but is prevented from rotating axially with respect to a longitudinal axis of the frame. During articulation, the arm interacts with an element that includes two inclined surfaces and provides traction for tightening the straps.

6 Claims, 4 Drawing Sheets

SKATE STRUCTURE WITH LONGITUDINALLY ALIGNED WHEELS

FIELD OF THE INVENTION

This invention relates to a skate structure with longitudinally aligned wheels.

DESCRIPTION OF THE PRIOR ART

Roller skates are known comprising an inverted U-shaped frame, in the flanges of which there engage a plurality of pivot pins for longitudinally aligned wheels. A plastic boot is fixed to the horizontal portion of the U-shaped frame. The boot is fixed in some cases by rivets which engage the boot sole, and in other cases by injection-moulding the boot sole onto the frame.

These known skates have however certain drawbacks, and in particular:

a considerable cost of the boxed unit as sold, due to the cost of the boot (which has to be rigidly incorporated in order to effectively transmit the leg movement to the frame) and of the metal frame, the need for the complete skate, ie the rigid boot plus metal frame, to be available in different user foot sizes, with consequent cost increase, a substantial weight and overall size.

An object of the invention is to eliminate these drawbacks by providing a roller skate structure which can be used with any type of footwear.

A further object of the invention is to provide a structure which effectively transmits the leg movement (lateral inclination) to the wheels.

A further object of the invention is to provide a structure which can be adapted to footwear of different sizes within a certain range.

BRIEF SUMMARY OF THE INVENTION

All these and further objects which will be apparent from the ensuing description are attained according to the invention by a skate structure with longitudinally aligned wheels comprising a sustantially inverted U-shaped frame, in the flanges of which there engage the ends of pivot pins for the wheels, characterised in that the upper surface of said frame is provided with at least one element for the removable fixing of an article of footwear of any type, in correspondence with the rear portion of said structure there being hinged an arm movable along the longitudinal axis of the frame but prevented from rotating axially, its upper end being provided with an element for securing to the user's leg.

BRIEF DESCRIPTION OF THE DRAWINGS

A preferred embodiment of the invention and two modifications thereof are described hereinafter by way of non-limiting example with reference to the accompanying drawings, on which.

DESCRIPTION OF PREFERRED EMBODIMENTS

Figure 1:
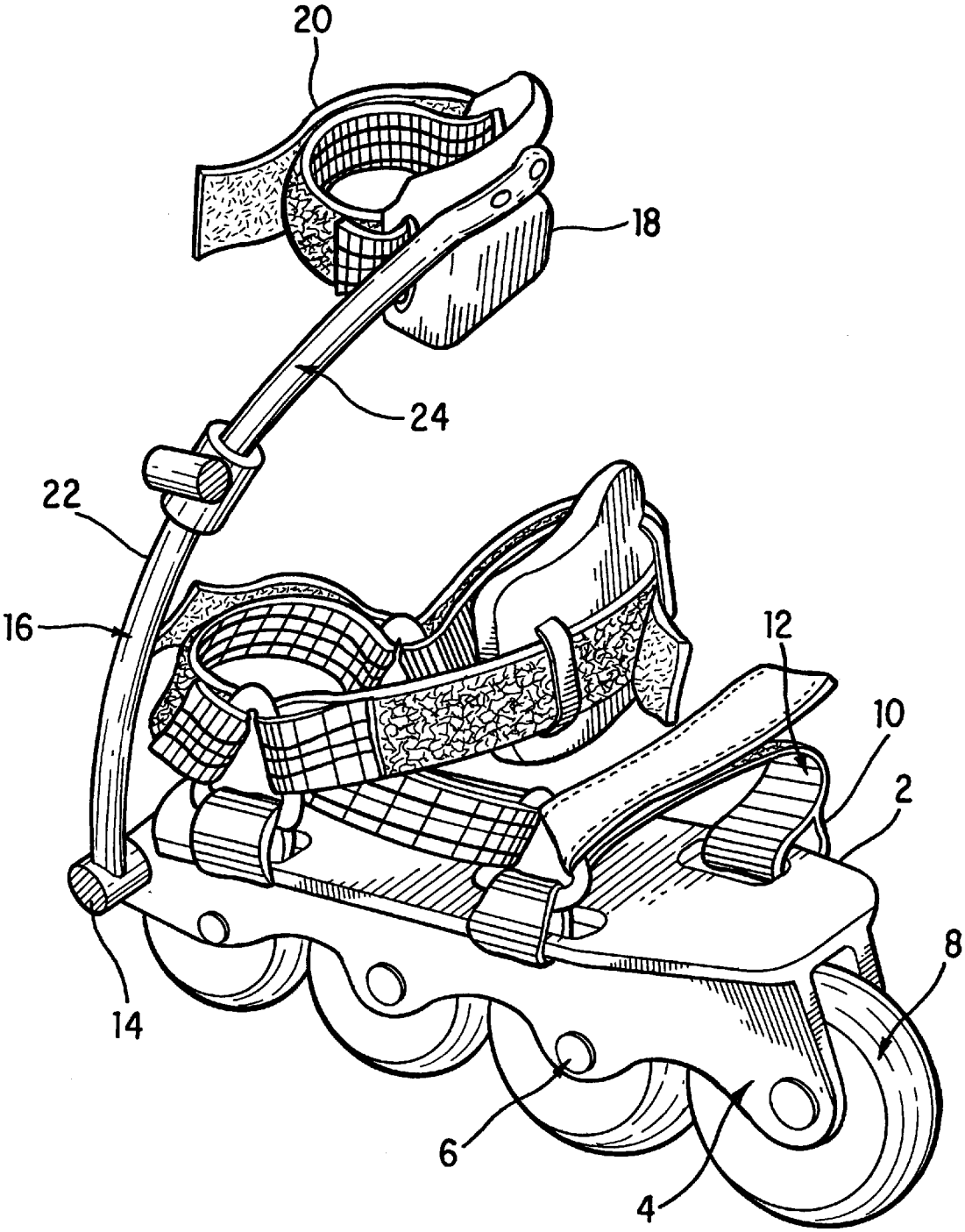
FIG. 1 is a perspective view of a skate structure according to the invention.

As can be seen from the figures, the roller skate structure according to the invention comprises substantially a metal frame 2 of substantially inverted-U section, in the flanges 4 of which there are provided a plurality of holes for engaging the ends of pivot pins 6 for longitudinally aligned wheels 8 of substantially rigid plastic.

The horizontal surface 9 of the U-shaped frame comprises a plurality of slotted holes 10 in which there engage hook and loop type fastener VELCRO® straps 12 for securing an article of footwear both at the instep and at the rear of the foot.

On the rear of the U-shaped frame there is provided a further pin 14 for pivoting a pusher arm 16 provided upperly with a padded curved element 18 with a VELCRO® band 20 for providing secure fixing to the leg.

The arm 16 is formed from two tubular elements 22, 24 which mutually engage telescopically and are adjustable either into predetermined positions or into any position by means for example of a micrometric thread.

The structure of the invention is used as follows.

The user rests his foot on the horizontal surface 9 of the frame while wearing any article of footwear.

The straps 12 are then engaged to completely lock the footwear, after which the curved element 18 of the arm 16 is rested on the front part of the leg and fixed thereto by the band 20. During this stage the user adjusts the elongation of the pusher arm so that the curved element 18 rests on the desired point of his leg. From the aforegoing it is apparent that the skate structure of the invention has numerous advantages, and in particular.

it can be used with any article of footwear, it can be used with shoes of different size and shape, it allows control of the angle of the skate to the ground, it allows variation of the force transmitted to the U-shaped structure and hence to the ground, it is of lesser weight and overall size than traditional already assembled skates.

Figure 2:
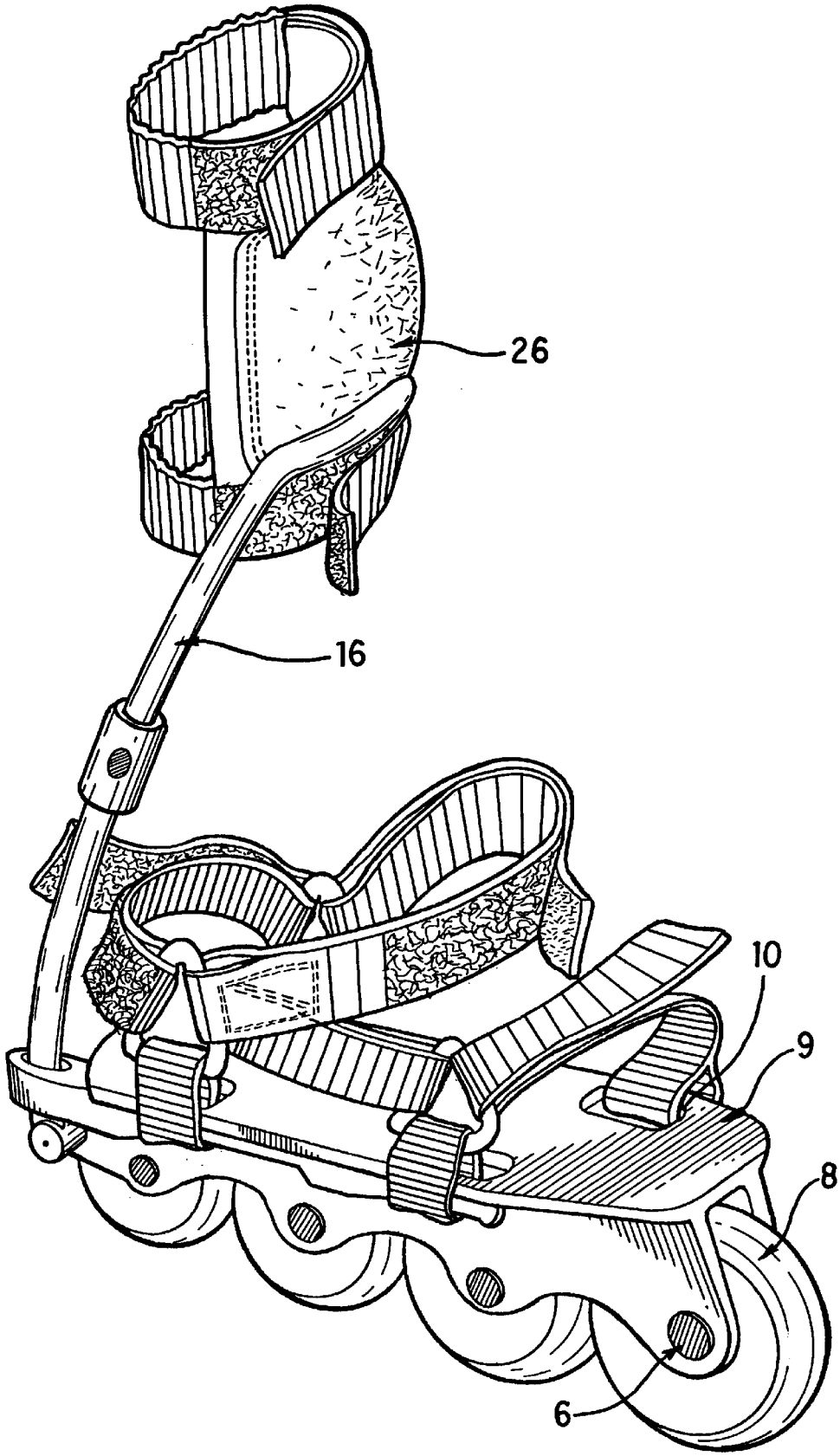
FIG. 2 shows a first modification thereof.

In the embodiment shown in FIG. 2, the arm is in the form of two separate elements connectable together as described heretofore, with the upper curved element of such dimensions as to reach knee level.

Figure 3:
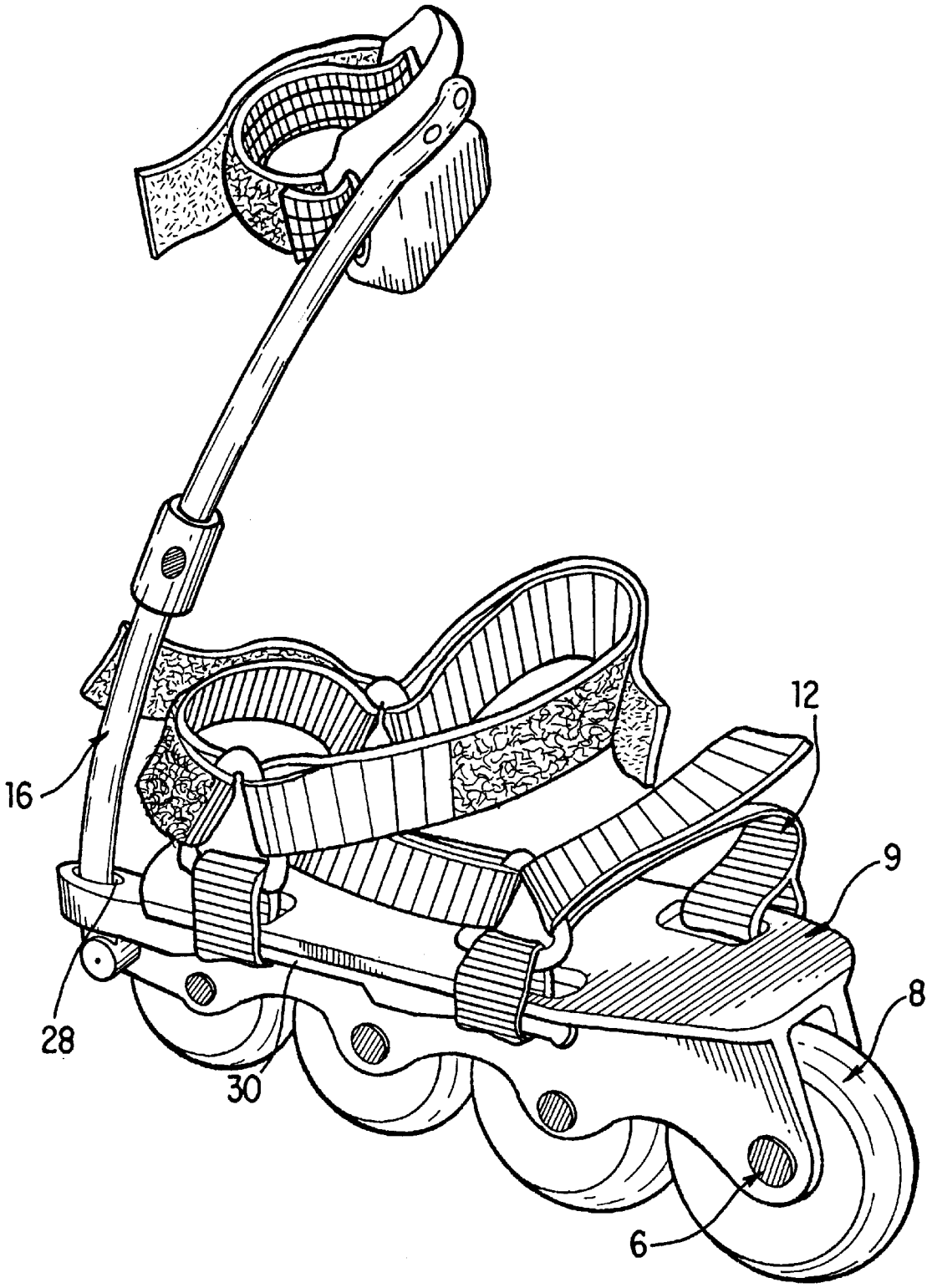
FIG. 3 shows a second modification thereof.
Figure 4:
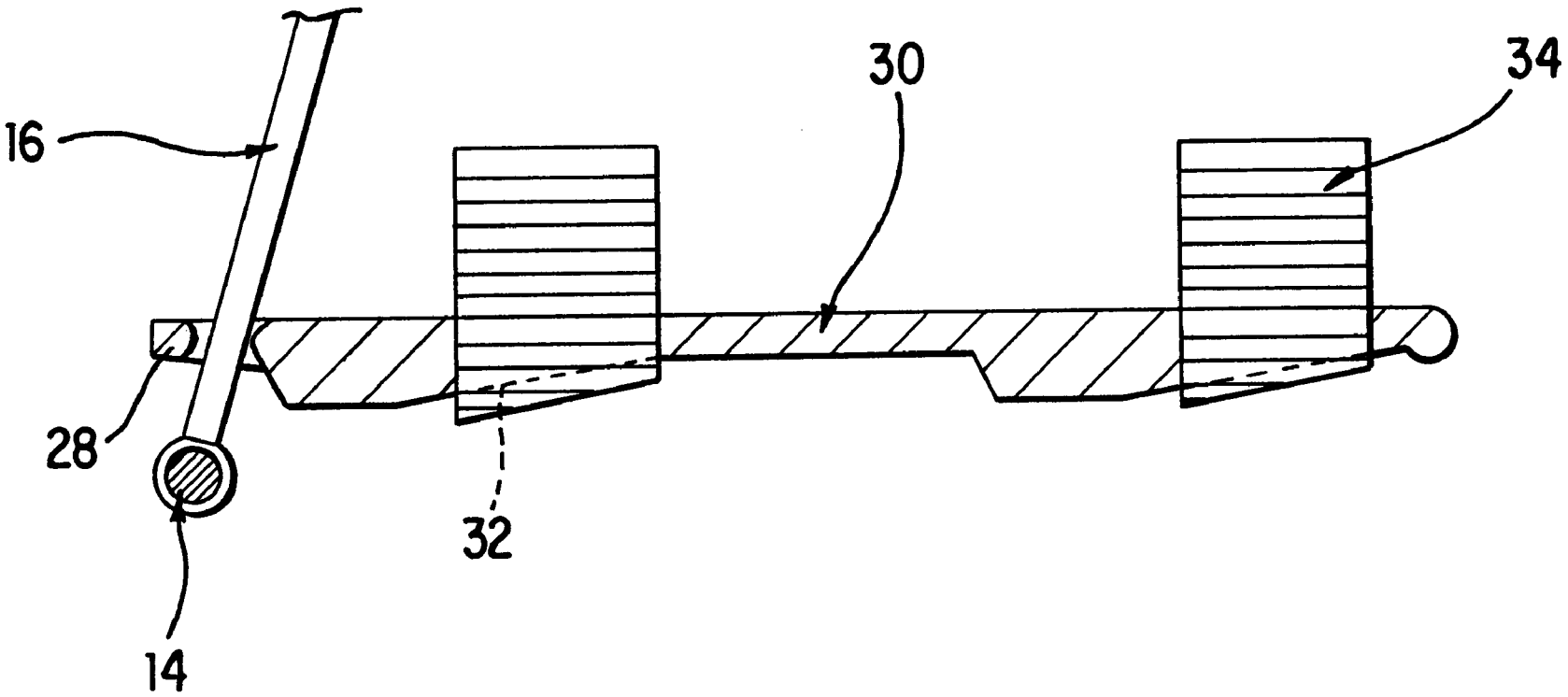
FIG. 4 shows a detail of this second modification.

In this embodiment said element is provided with a knee guard 26. In the embodiment illustrated schematically in FIGS. 3 and 4, the pusher 16 engages in a hole 28 provided in a tightening element 30 positioned to the rear of a lateral edge of the horizontal surface 9. Said tightening element lowerly comprises two inclined portions 32 interacting with two tape rings 34 which also secure the straps 12.

This embodiment has the further advantage of causing traction to be exerted on the straps during the axial movement of the tightening element 30 which occurs on bending the legs, with consequent greater clamping of the articles of footwear. In a different embodiment (not shown on the drawings), a coil spring is positioned coaxially to the pin 14 with its ends interacting with the structure 2 and arm 16. In the absence of external stress the spring maintains the arm 16 substantially in a vertical configuration. This embodiment provides elastic return to the starting position following flexure.

In a further embodiment (not shown on the drawings) the U-shaped frame 2 consists of two pieces engaging telescopically. This embodiment has the further advantage of adapting to articles of footwear of different sizes within a wide range.

I claim:

1. A skate structure with longitudinally aligned wheels comprising an inverted U-shaped frame, flanges which engage ends of pivot pins for the wheels, wherein an upper surface of said frame is provided with at least one fixing element for the removable fixing of an article of footwear, in correspondence with a rear portion of said structure there being hinged an arm pivotal about the pivot axis of a hinge, and prevented from rotating axially about the longitudinal axis of the frame, its upper end being provided with an upper element for securing to a user's leg; and wherein during articulation, the arm interacts with a traction element that provides traction on straps for tightening of the straps and wherein the traction element for the straps comprises two inclined surface portions.

2. A skate structure as claimed in claim 1, wherein the arm is formed from two telescopically engageble elements.

3. A skate structure as claimed in claim 2, wherein the two telescopically engageable arm elements are mutually adjustable.

4. A skate structure as claimed in claim 1, wherein the upper element of the arm is provided with a padded element.

5. A skate structure as claimed in claim 4, wherein the padded element is a knee guard.

6. A skate structure as claimed in claim 1, wherein the fixing elements for the article of footwear consist of hook and loop fastener straps.

* * * * *